US008133111B2

(12) United States Patent
Thomas

(10) Patent No.: US 8,133,111 B2
(45) Date of Patent: Mar. 13, 2012

(54) WAGERING GAME WITH SYMBOL ARRAY DEFINED BY MULTI-SYMBOL OBJECTS

(75) Inventor: Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 607 days.

(21) Appl. No.: 12/299,725

(22) PCT Filed: May 7, 2007

(86) PCT No.: PCT/US2007/011009

§ 371 (c)(1),
(2), (4) Date: Nov. 5, 2008

(87) PCT Pub. No.: WO2007/136537

PCT Pub. Date: Nov. 29, 2007

(65) Prior Publication Data

US 2009/0137309 A1 May 28, 2009

Related U.S. Application Data

(60) Provisional application No. 60/798,535, filed on May 8, 2006.

(51) Int. Cl.
*A63F 9/24* (2006.01)

(52) U.S. Cl. ..... 463/20; 463/32

(58) Field of Classification Search ..... 463/1–47; 273/143 R

See application file for complete search history.

(56) References Cited

U.S. PATENT DOCUMENTS

| | | | | |
|---|---|---|---|---|
| 6,123,333 | A * | 9/2000 | McGinnis et al. | 273/146 |
| 6,932,700 | B2 | 8/2005 | Bennett et al. | 463/20 |
| 2001/0016513 | A1 | 8/2001 | Muir et al. | 463/16 |
| 2002/0036380 | A1 * | 3/2002 | Perrie et al. | 273/146 |
| 2002/0094857 | A1 * | 7/2002 | Meyer | 463/16 |
| 2003/0064790 | A1 * | 4/2003 | Hughs-Baird et al. | 463/20 |
| 2003/0211879 | A1 * | 11/2003 | Englman | 463/20 |
| 2004/0043809 | A1 * | 3/2004 | Gomez et al. | 463/16 |
| 2004/0048650 | A1 * | 3/2004 | Mierau et al. | 463/20 |
| 2004/0102244 | A1 * | 5/2004 | Kryuchkov et al. | 463/32 |
| 2006/0068900 | A1 * | 3/2006 | Englman | 463/25 |
| 2008/0045313 | A1 * | 2/2008 | Yoshizawa | 463/20 |
| 2009/0227357 | A1 * | 9/2009 | Rasmussen | 463/21 |

OTHER PUBLICATIONS

International Search Report—PCT/US07/011009 dated Jun. 11, 2008 (2 pages).

Written Opinion—PCT/US07/0011009 dated Jun. 11, 2008 (4 pages).

* cited by examiner

*Primary Examiner* — Peter DungBa Vo
*Assistant Examiner* — Steve Rowland
(74) *Attorney, Agent, or Firm* — Nixon Peabody LLP

(57) ABSTRACT

A gaming system for conducting a wagering game includes a display for displaying a plurality of multi-symbol objects having a plurality of sides so that the objects appear as three-dimensional objects. Similar to the reels in a traditional gaming machine, the multi-symbol objects randomly move into locations on the display forming an array wherein one side of each multi-symbol object is displayed, the displayed side having a symbol. The location of the multi-symbol objects in the array and the side of each multi-symbol object that is displayed is based on a randomly selected outcome of the wagering game.

21 Claims, 11 Drawing Sheets

WAGERING GAME WITH SYMBOL ARRAY DEFINED BY MULTI-SYMBOL OBJECTS

CROSS-REFERENCE TO RELATED APPLICATIONS

This application is a U.S. national stage of International Application No. PCT/US2007/011009, filed May 7, 2007, which is related to and claims the benefit of U.S. Provisional Application No. 60/798,535, filed May 8, 2006, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having a plurality of multi-symbol objects. Each of the multi-symbol objects has a plurality of sides for forming a three-dimensional object and each side of the object includes a symbol. As game play is initiated, the multi-symbol objects tumble into an array wherein one side of each multi-symbol object is displayed to the player. The location of each multi-symbol object in the array and the side of each multi-symbol object that is displayed is randomly determined.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Additionally, there is a need for improved gaming enhancements that distinguish a wagering game from traditional wagering games but are similar enough that players feel comfortable moving from the traditional wagering game to the enhanced wagering game, and vice versa.

SUMMARY OF THE INVENTION

According to one aspect of the present invention, a gaming system includes a display for displaying a wagering game having a plurality of multi-symbol objects. Each of the plurality of multi-symbol objects has a plurality of sides to cause said multi-symbol objects to appear as three-dimensional objects. At least some of the sides have a symbol. The display displays an array containing an arrangement of the plurality of multi-symbol objects such that one side of each multi-symbol object is displayed in the array. The arrangement of the multi-symbol objects in the array indicates a randomly selected outcome of the wagering game in response to receiving a wager input from a player.

According to another aspect of the invention, a method of conducting a wagering game on a gaming system comprises receiving a wager input for playing the wagering game. The wagering game includes a plurality of multi-symbol objects. The multi-symbol objects have a plurality of sides that form a three-dimensional object. At least some of the sides have a symbol. The method also comprises randomly determining the location of each of the multi-symbol objects in an array and randomly determining the side of each multi-symbol object to be displayed to a player in the array. The method further comprises displaying the array of the multi-symbol objects to a player.

According to yet another aspect of the invention, a computer readable storage medium is encoded with instructions for directing a gaming system to perform the above method.

According to a further aspect of the invention, a gaming system comprises a video display for displaying a wagering game having a plurality of three-dimensional objects. Each of the plurality of three-dimensional objects has a plurality of symbols. The gaming system further comprises a controller connected to the video display. The controller is operative to initiate game play by moving each of the three-dimensional objects on the video display into a randomly selected location with a randomly selected symbol being displayed. The symbols from the three-dimensional objects indicate an outcome of the wagering game.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
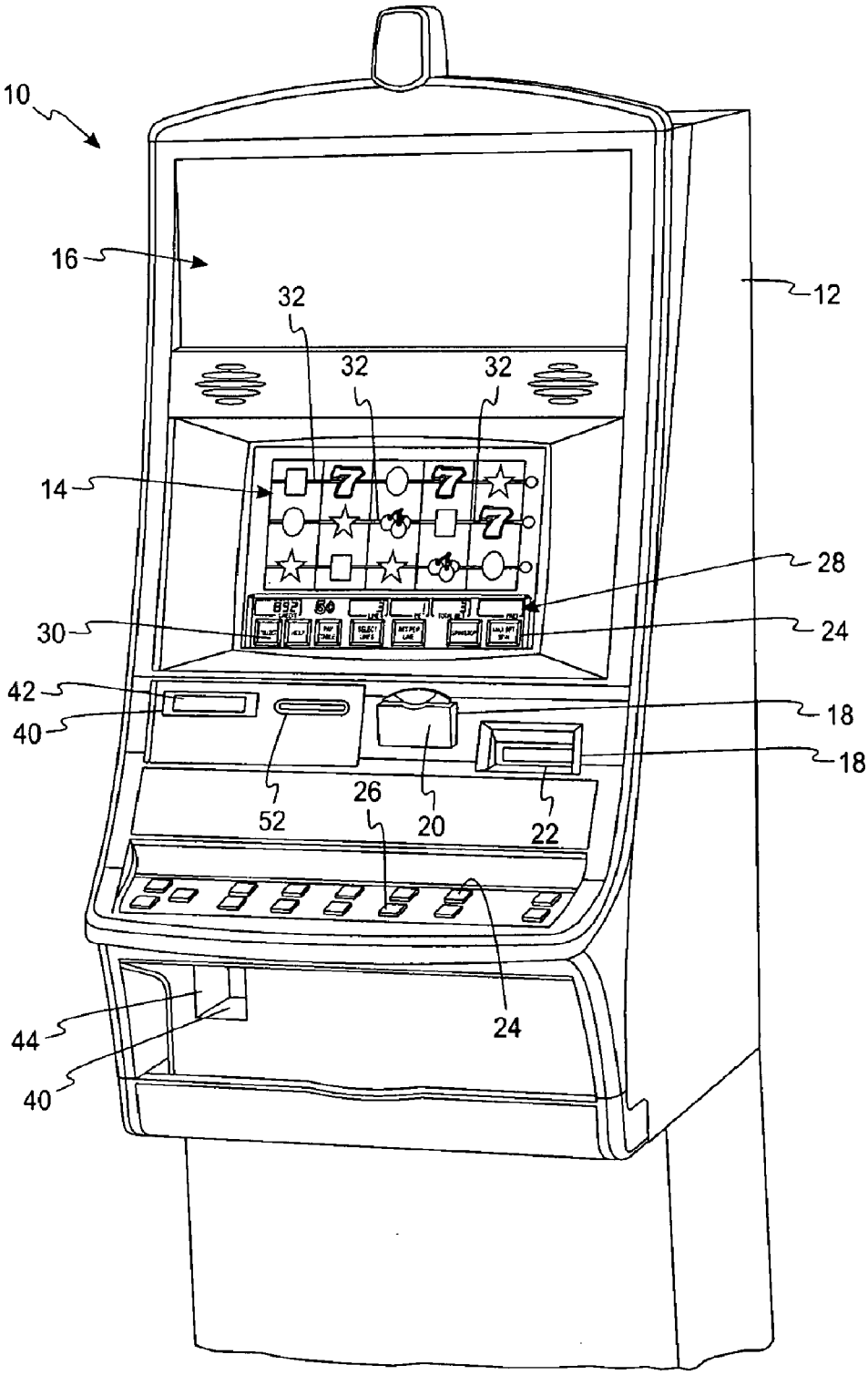
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
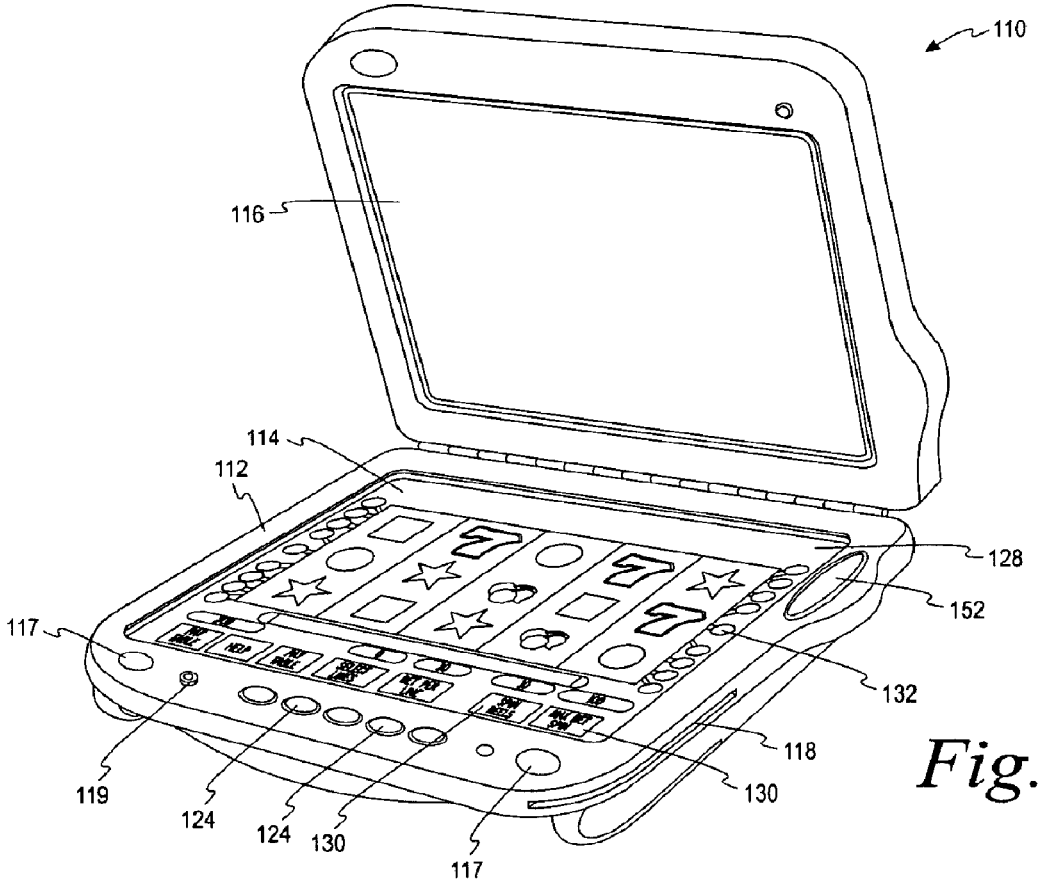
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110.

The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
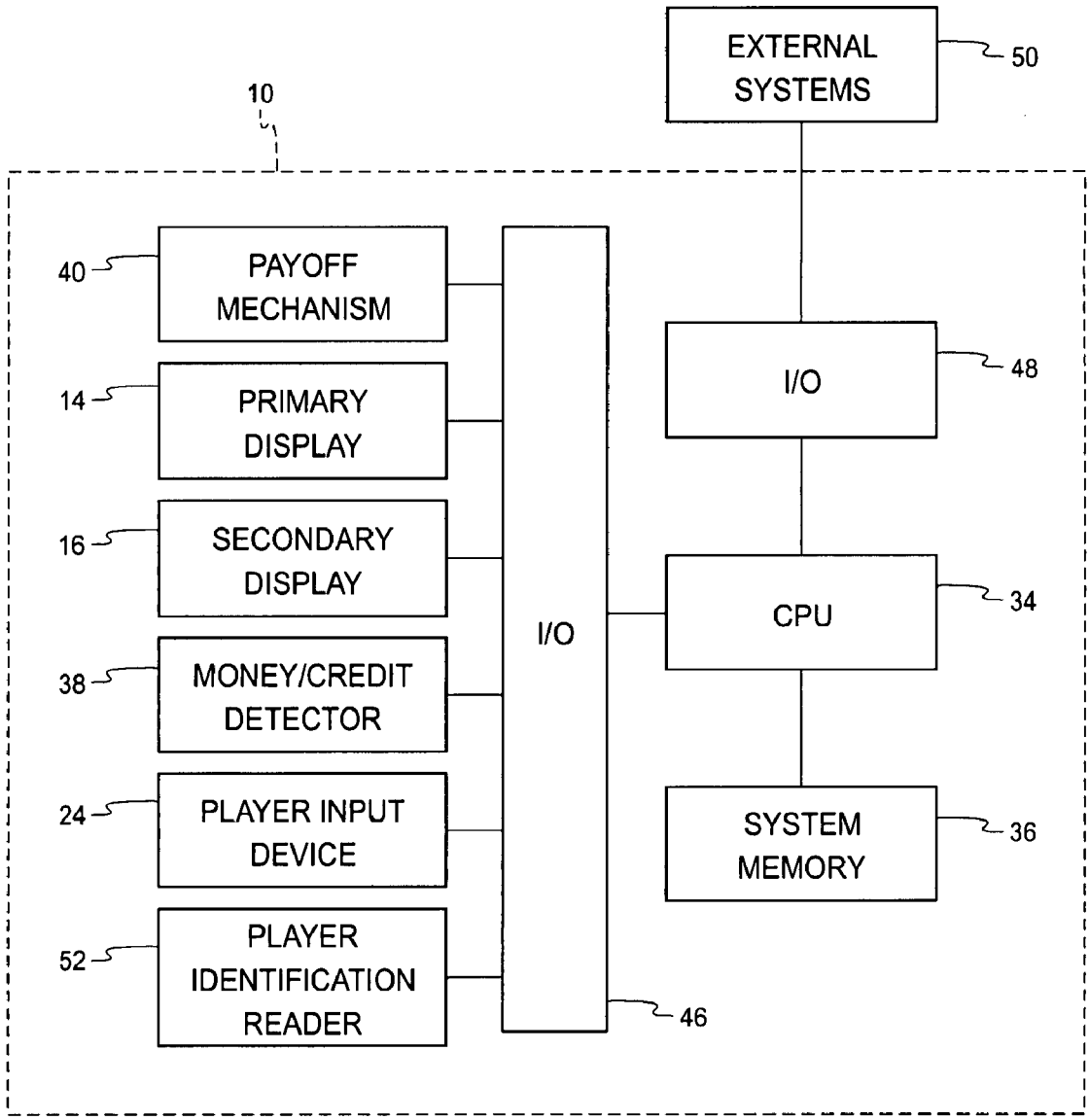
FIG. 2 is a block diagram of a control system suitable for operating the gaming machine of FIGS. 1*a* and 1*b*.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
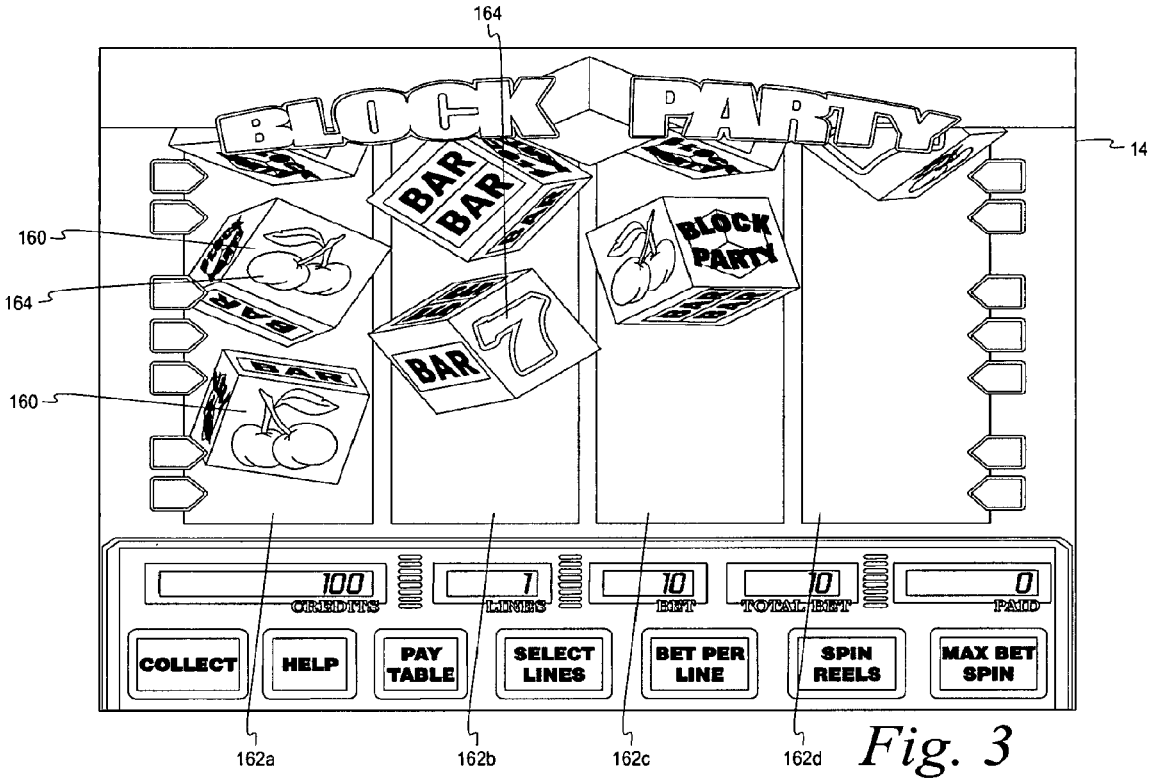
FIG. 3 is a display of a gaming machine of FIG. 1 displaying a group of three-dimensional multi-symbol objects according to one embodiment of the present invention.

Turning now to FIG. 3, the primary display 14 of one embodiment of the present invention is shown in more detail. In this embodiment, the basic wagering game is a four-reel video slot machine game, shown as "BLOCK PARTY." The player obtains credits on the gaming machine 10 by inserting money in the form of bills, printed tickets, coins and/or tokens in the coin acceptor 20 or bill acceptor 22. Once the credits appear on the "Credits" display, the player may begin by selecting paylines and the number of credits to wager on each selected payline.

Once the player places a wager amount and initiates game play, a plurality of multi-symbol objects 160 are displayed as tumbling down from the top of the primary display 14 into random columns or reels 162*a*, 162*b*, 162*c*, 162*d* in the primary display 14. The tumbling is similar to the spinning of the reels in a standard video or mechanical slot gaming machine in that the multi-symbol objects 160 are settled into positions in the columns or reels 162*a*-162*d* in association with a number of standard paylines having indicators (not shown in FIG. 3). However, unlike flat, linear reels of standard video or mechanical slot gaming machines, the multi-symbol objects 160 can tumble in any direction instead of just up or down, like a traditional flat reel. Additionally, in some embodiments, the multi-symbol objects 160 may rotate after the tumble in special bonus features described below in FIGS. 7*a*-7*d*.

Each of the multi-symbol objects 160 has a plurality of sides. In the embodiment shown in FIG. 3, each of the multi-symbol objects 160 has six sides forming a three-dimensional cube or block. Alternatively, the multi-symbol objects 160 may have one continuous three-dimensional surface such as a sphere. At least some of the sides of each multi-symbol object 160, and preferably all of the sides, include a symbol 164. In one embodiment, each symbol 164 on the six-sided multi-symbol object 160 has the same probability of being displayed as the other symbols 164. In an alternative embodiment, a method may be used that increases the "weight" or probability of a particular side or symbol being displayed. Due to the three-dimensional nature of the multi-symbol object 164, the "weighted" side may not necessarily be the side or symbol that is likely to be displayed. For example, the "weighted" side may be the side that is most likely to face downward, thus causing a different side or symbol to be displayed. This particular type of weighting system may be described as an "offset weighting of symbol probabilities."

Some of the symbols 164 on the multi-symbol objects 160 displayed in FIGS. 3-7 include a CHERRY, a GOLD CHERRY, a SINGLE BAR, a DOUBLE BAR, a BLOCK PARTY symbol, a BONUS BLOCK symbol and a LUCKY 7. The symbols 164 described herein are not meant to limit the possible symbols 164 that may be used with the present invention as it is contemplated that many different symbols 164 may be used. Additionally, each symbol 164 need not appear on each multi-symbol object 160 and each multi-symbol object 160 need not have identical symbols. Furthermore, it is contemplated that the multi-symbol objects 160 may have more or less than 6 sides and may thus take the form of different three-dimensional objects. Moreover, each side of the multi-symbol object 160 may bear more than one symbol 164.

Figure 4:
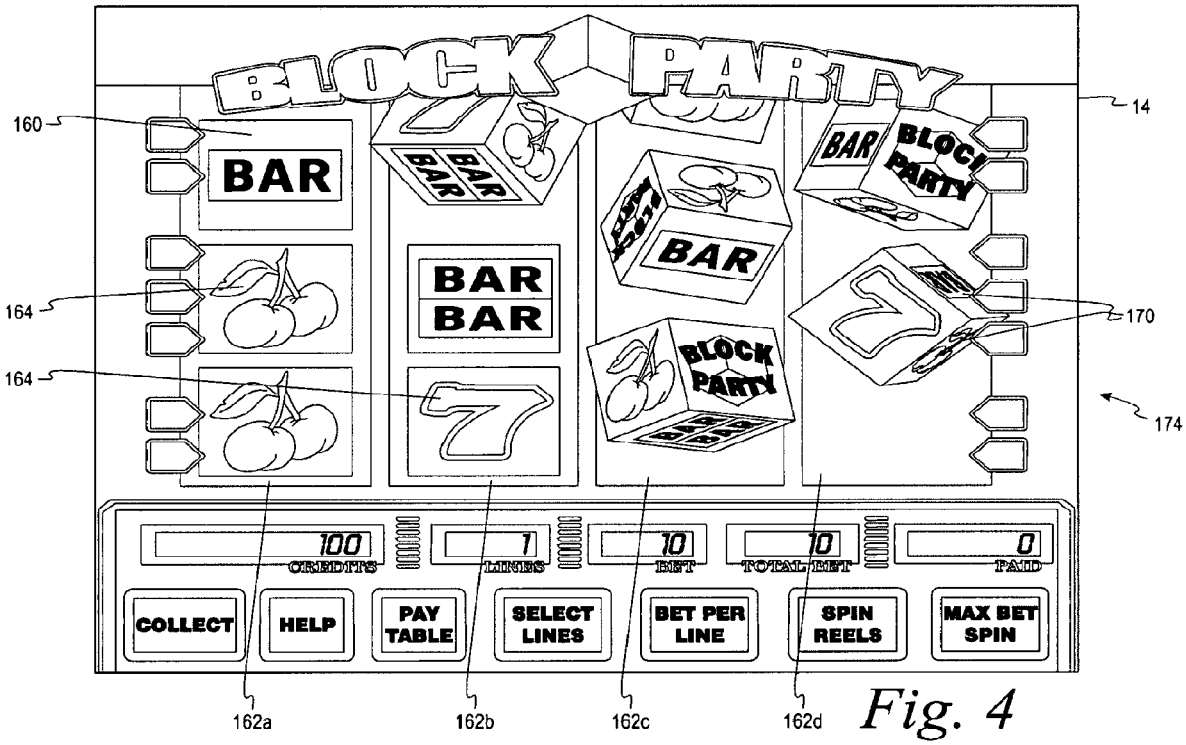
FIG. 4 is a display of a gaming machine of FIG. 1 displaying the three-dimensional multi-symbol objects as the objects move into locations in an array according to one embodiment of the present invention.
Figure 5:
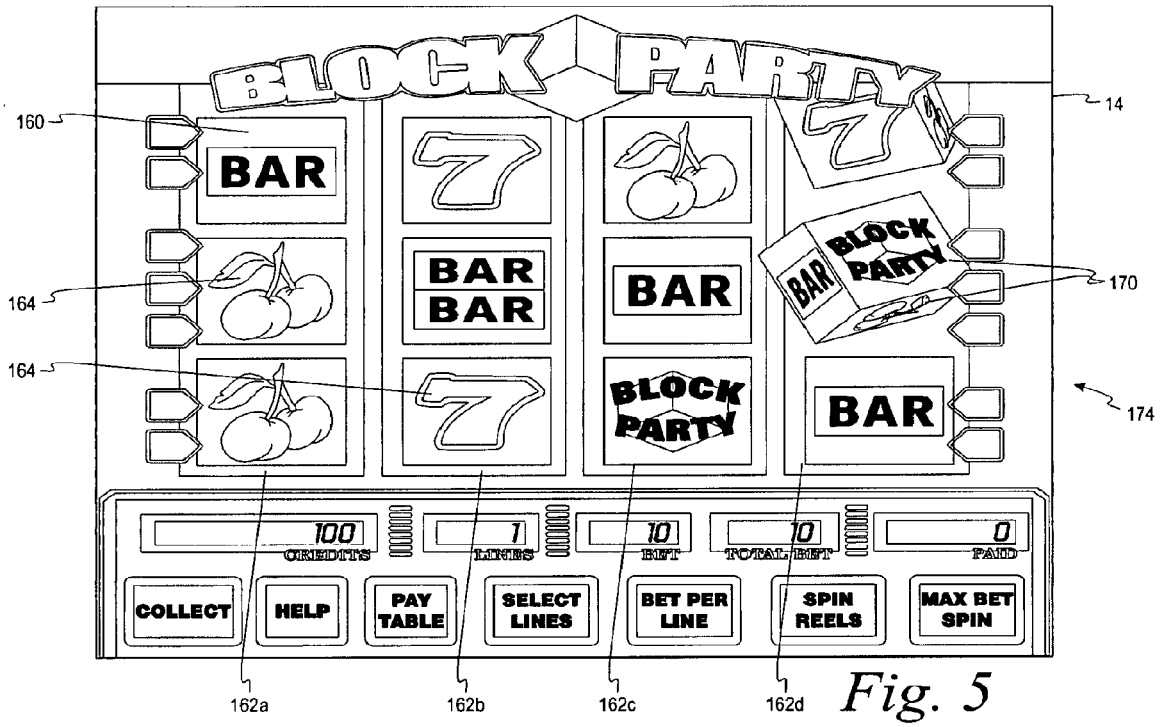
FIG. 5 is a display of a gaming machine of FIG. 1 displaying the three-dimensional multi-symbol objects as the objects settle into locations in the array according to one embodiment of the present invention.

As the multi-symbol objects 160 continue to tumble into the columns or reels 162, as shown in FIGS. 4 and 5, different sides 170 of each multi-symbol object 160 may be displayed to the player. Upon settling into various positions, the resulting displayed side 170 of each multi-symbol object 160 results in an array 174 of symbols 164. In the embodiments shown in FIGS. 3-7, the array 174 is comprised of a three-column by four-row set of multi-symbol objects 160. The columns of the array 174 may be filled all at the same time or may be filled in a predetermined order, such as left to right as shown in FIGS. 3-5.

In one preferred embodiment, the location of each multi-symbol object 160 within the array 174 is randomly determined by the controller 34. Likewise, the side 170 of each multi-symbol object 160 that is displayed in the array 74 is also randomly determined by the controller 34. Thus, both the location of the multi-symbol objects 160 and the displayed sides 170 of the multi-symbol objects 160 are randomly determined based on the randomly selected outcome of the basic wagering game.

Figure 6:
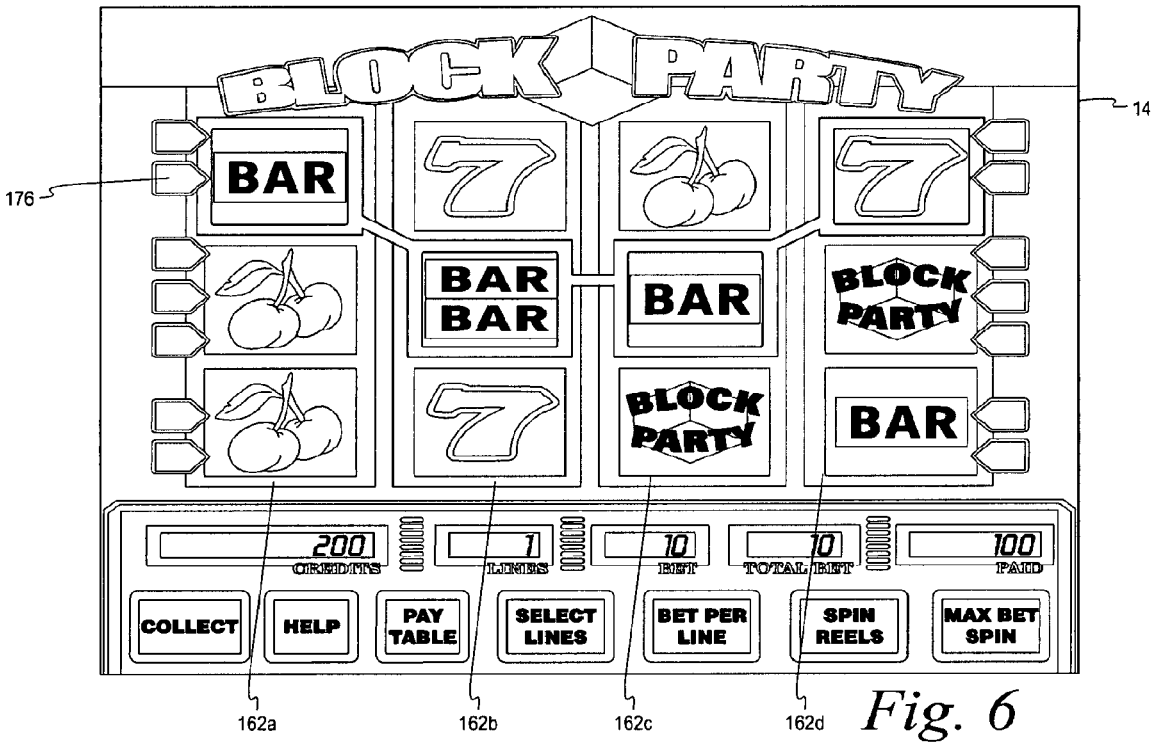
FIG. 6 is a display of a gaming machine of FIG. 1 displaying a winning outcome associated with the multi-symbol objects according to one embodiment of the present invention.

After all of the multi-symbol objects 160 are settled into their random positions in the array 174, all active paylines are evaluated for winning outcomes. For the embodiment described herein, typical four-symbol payline configurations may be used. As shown in FIG. 6, payline 176 is associated with a winning outcome that includes three BAR symbols and a LUCKY7 symbol. In the same manner as standard, two-dimensional spinning reel games, players are awarded an award associated with each winning outcome along any of the active paylines. Because the evaluation of the winning outcomes and the associated awards are similar to other spinning reel games, players feel comfortable playing both types of wagering games and can easily transition between playing conventional two-dimensional spinning reel games and the innovative three-dimensional tumbling multi-symbol object games of the present invention.

Figure 7A:
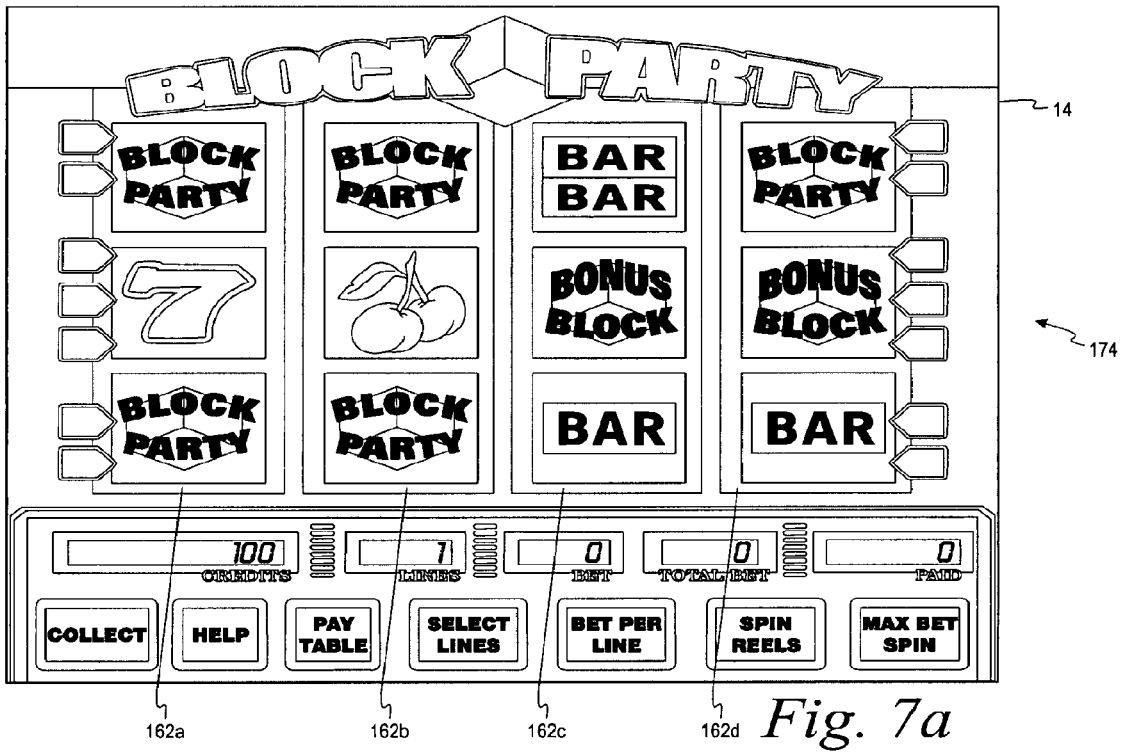
FIGS. 7*a*-7*d* are displays of a gaming machine of FIG. 1 displaying various bonus features involving the three-dimensional multi-symbol objects according to several embodiments of the present invention.
Figure 7B:
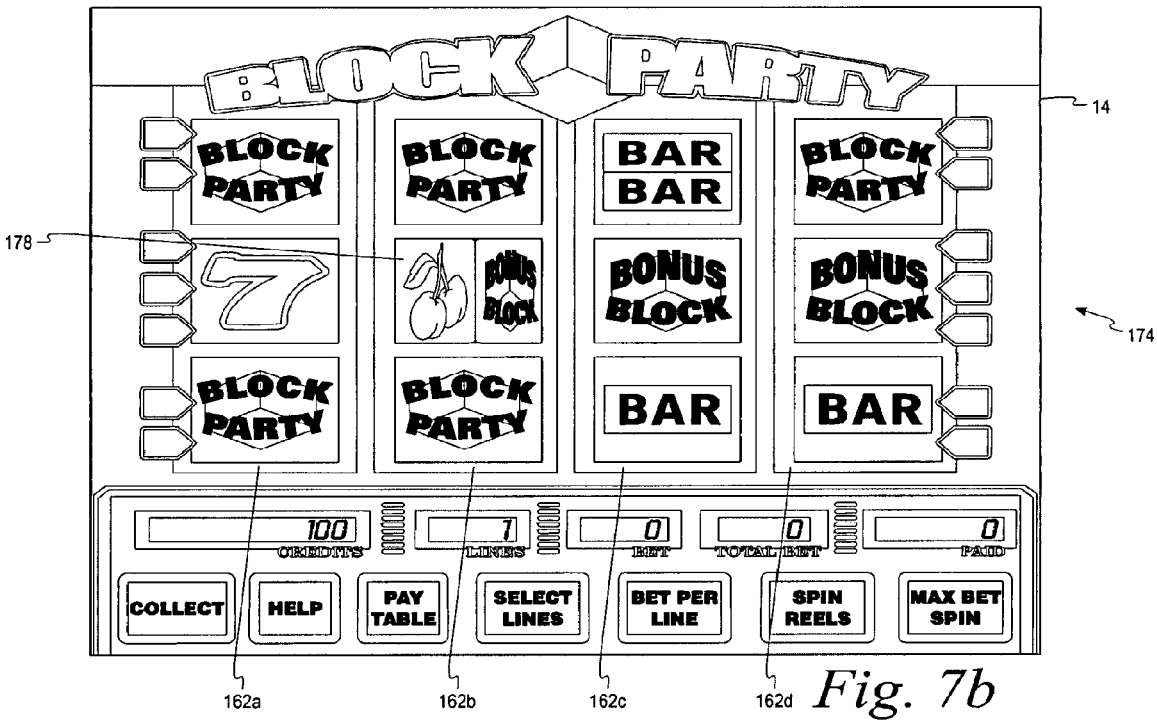

Some unique features may be implemented with the wagering game of the present invention due to the three-dimensional nature of the multi-symbol objects 160. Such features may be used in standard spinning reel wagering games but have a different effect when used with the three-dimensional multi-symbol object game of the present invention. For example, FIGS. 7*a*-7*d* illustrate features similar to a traditional reel nudge in standard spinning reel wagering games. Specifically, FIG. 7*a* shows a primary display 14 after the multi-symbol objects 160 have come to rest in the three by four array 174. After evaluation of the symbols 164 to determine whether any winning outcomes are present, at least one of the multi-symbol objects 160 may be nudged such that the multi-symbol object 160 is rotated in any one of several directions. For example, as shown in FIG. 7*b*, the multi-symbol object 178, which is initially a GOLD CHERRY symbol, is nudged, or rotated, to the left. While the multi-symbol object 178 is rotated to the left in this particular embodiment, the multi-symbol object 178 may be nudged or rotated in any other direction, such as right, up or down. Preferably, the nudge results in a more favorable outcome to the player. In this case, the multi-symbol object 178 now displays a BONUS BLOCK symbol instead of a GOLD CHERRY symbol. Once this nudge occurs, the modified symbol array may indicate a new winning outcome. For example, now there are three BONUS BLOCK symbols in the second row of the array 174 that may indicate a new winning outcome and provide an additional bonus award.

In another embodiment, a multi-symbol object 160 is nudged to a half-way position such that one symbol location in the array 174 may be associated with two possible symbols 164. This feature offers the player a better chance for achieving a winning symbol combination as either or both of the two symbols 164 may be used to indicate a winning outcome. Alternatively, a multi-symbol object 160 may be nudged to a position such that one symbol location in the array 174 may be associated with three possible symbols 164 (where, for example, a corner of the multi-symbol object 160 is displayed to the player). The player's chances of achieving a winning combination may be increased even more as one of three possible symbols 164 may be used to create the winning outcome.

Figure 7C:
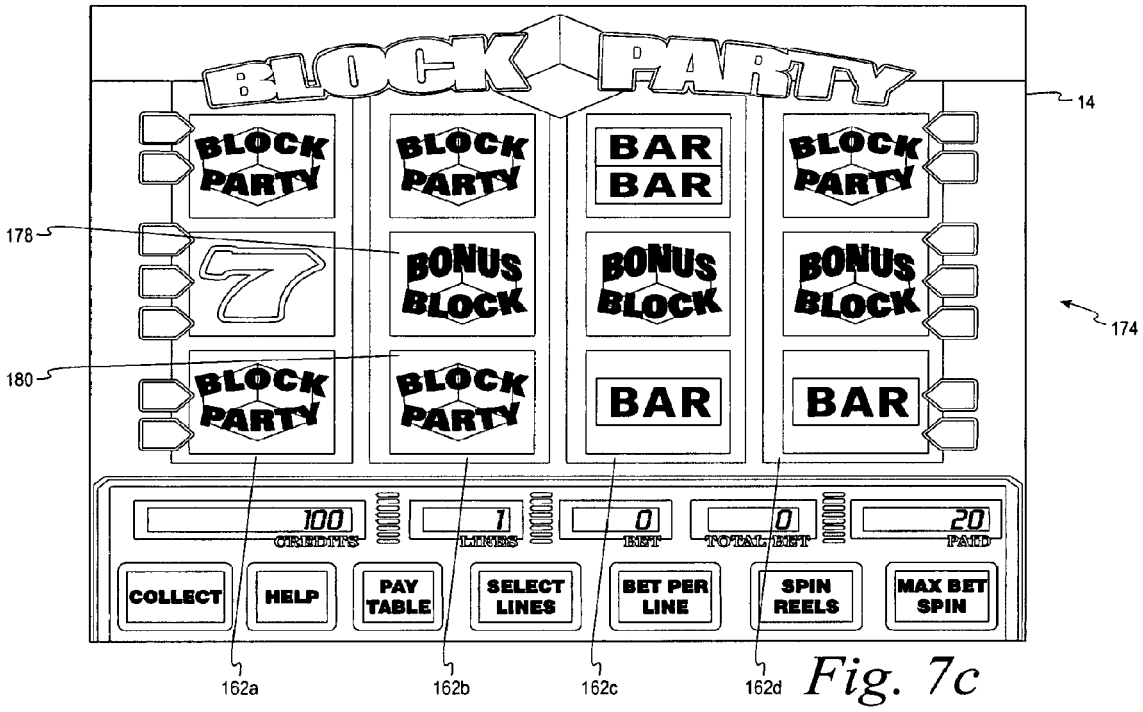
Figure 7D:
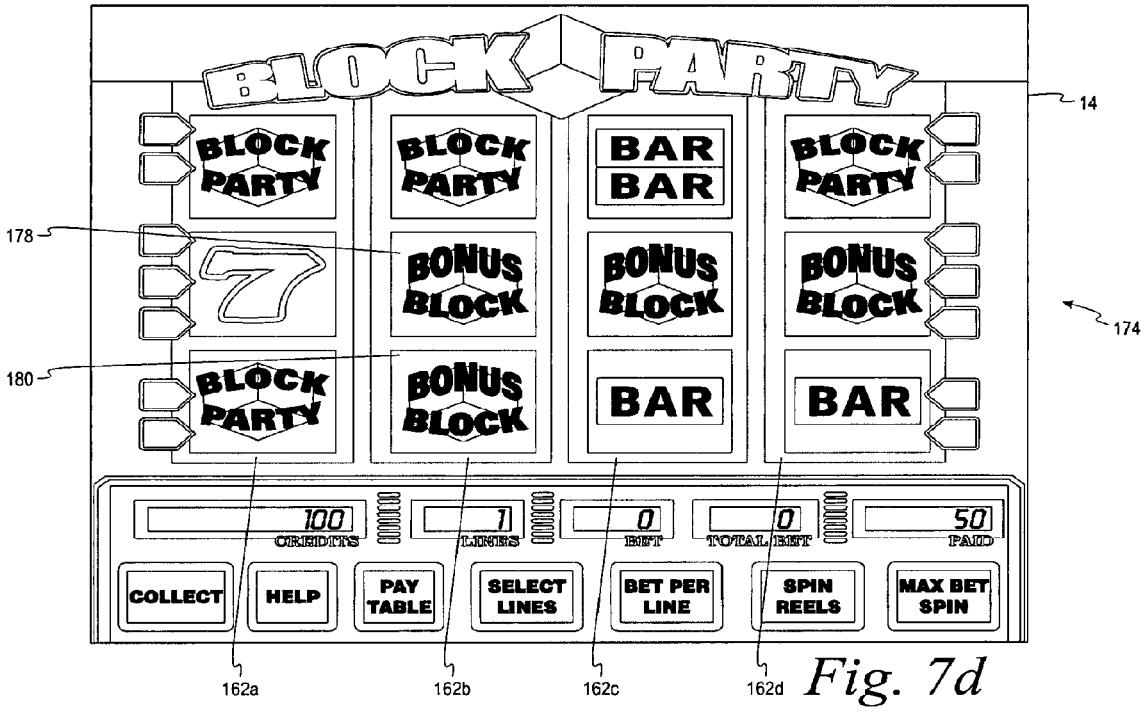

In some features of the present embodiments, the nudge may allow the multi-symbol object 178 to interact with adjacent multi-symbol objects 160. This feature is sometimes called a "viral bonus" or a "viral nudge." The viral bonus feature allows nudging of multi-symbol objects 160 to duplicate symbols on adjacent multi-symbol objects 160. This "viral effect" can increase the number of winning symbols in the array 174, causing higher paying bonus awards or multiplying certain bonus awards. For example, the multi-symbol object 178 that was nudged from a GOLD CHERRY symbol to a BONUS BLOCK symbol may now have the effect of nudging multi-symbol object 180 from a BLOCK PARTY symbol (as shown in FIG. 7*c*) to a BONUS BLOCK symbol (as shown in FIG. 7*d*) to match multi-symbol object 178. Thus, the nudging effect shown in FIGS. 7*a*-7*d* has turned an array 174 having two gold BONUS BLOCK symbols into an array 174 having four gold BONUS BLOCK symbols. This may allow the player to be awarded a larger bonus award or to enter a bonus game with more triggering symbols. The viral nudge may continue in a chain reaction until no more gold symbols can be turned into gold bonus symbols.

In a further embodiment, an "all-side" bonus (not shown) may occur in response to a certain condition or event. According to this feature, once the array 174 is filled with the multi-symbol objects 160 and the array 174 is evaluated for any winning outcomes, each of the multi-symbol objects 160 rotates (either in unison or in a predetermined order) in one direction, i.e., the multi-symbol objects 160 rotate to the left, to display a new set of symbols 164. The new set of symbols 164 is then evaluated and the player is awarded any winning outcomes. The multi-symbol objects 164 are rotated again to the left and another new set of symbols 164 is display and evaluated for any winning outcomes. The rotation continues until all six sides have been displayed and evaluated. This bonus amounts to having six different plays of the wagering game since the player can win on each of the six possible arrays 174 that result. In this example, if there are 7 active paylines, then there are a total of 42 possible ways to win. This bonus may be triggered by, for example, a predetermined condition, such as achieving a certain symbol in the certain position in the array 174, or any other triggering event as described herein.

Further distinguishing features relating to the multi-symbol objects 160 include allowing individual multi-symbol objects 160, a set of the multi-symbol objects 160 and/or any one of the columns or reels 162*a*-162*d* to change position since the multi-symbol objects 160 and the columns or reels 162*a*-162*d* are not required to remain in the same position from spin to spin. Special reels, or bonus reels, as well as special multi-symbol objects 160, can be placed in a pool of available multi-symbol objects or reels and can replace any multi-symbol objects 160 and column or reel 162*a*-162*d*. In some embodiments, these replacement multi-symbol objects 160 or reels 162*a*-162*d* may not be displayed to the player until after the replacement occurs.

In some embodiments, the special reels are gold reels in which all symbols on these reels are gold symbols. When gold bonus symbols appear next to gold non-bonus symbols, the non-bonus symbols are automatically nudged to bonus symbols. This allows the player to achieve enough bonus symbols to enter the bonus more frequently or to enter a higher qualifying spin (or tumble) and thus win more once in the bonus game.

In other embodiments, gold reels and their associated gold symbols may have special significance. For example, combinations of gold symbols may trigger a bonus game or award, multiply awards, etc. Additionally, since the multi-symbol objects 160 are randomly placed into the array 174, the location of special multi-symbol objects 160 within the array 174 may change between reel tumbles, which is not possible with traditional static reels. Additional game play may be awarded depending on the proximity of the special reels or symbols to other special reels or symbols. Moreover, an award amount may be determined by the location of the special symbols, i.e., where the special symbols appear in the array 174, as well as which special symbols are displayed.

All of the special features of the embodiments described herein are not meant to be limited to bonus symbols, but may include other symbols as well, such as symbols which are changed or moved on certain reels depending on symbols that appear on adjacent reels, higher paying symbols, multiplier symbols. etc. Other special features may include having one more of the multi-symbol objects 160 displayed in the array 174 such that more than one side of the multi-symbol object 160 is displayed to the player. This can occur, for example, when a corner of the multi-symbol object 160 directly faces the player and the three sides that come to form the corner are shown to the player. Such a feature may be displayed as a wild-type symbol where any one of the three symbols may be used to complete a winning combination.

With all of the embodiments of the present invention described herein, different wagering strategies can be employed that may be similar to traditional wagering strategies. For example, with some embodiments, a familiar five-reel wagering strategy may be used, with multiple paylines and bets per payline; or a more traditional mechanical-type wagering strategy may be used with limited paylines, or a hybrid of the two may be used. The type of wagering strategy used may depend on the particular wagering game being played and is not meant to be limited to any specific format. Similarly, a pay table for the embodiments described herein, like the paylines and wagering strategy, may be designed for a particular wagering game and may be independent of the features used in the wagering games described herein. A typical left-to-right hierarchical pay table will work with the multi-symbol objects 160 reel configurations and may pay like any mechanical or video slot wagering game. Thus, no special type of pay table is required for the embodiments of the present invention.

Each of these embodiments and obvious variations thereof is contemplated as falling within the spirit and scope of the claimed invention, which is set forth in the following claims.

What is claimed is:

1. A gaming system configured to conduct a wagering game including a randomly generated outcome, the system comprising:

at least one input device:

one or more display devices for displaying a plurality of three-dimensional multi-symbol objects, each of the plurality of multi-symbol objects having at least three symbol-bearing sides;

one or more processors; and at least one memory device storing instructions that, when executed by the one or more processors, cause the one or more processors to operate with the at least one input device and the one or more display devices to:

receive a wager initiating a play of the wagering game;

display an array of multi-symbol objects of the plurality, the array produced by displaying the multi-symbol objects separately tumbling downwards to settle in columns, the objects each rotating about multiple axes and displaying at least two of the symbol-bearing sides prior to settling, the objects settling such that at least one side of each object is displayed in the array, the symbols on the displayed symbol-bearing sides indicating an initial randomly selected outcome of the wagering game; and after displaying the symbols of the initial outcome, nudge at least one of the multi-symbol objects to display a different side of the nudged multi-symbol object, wherein the symbols on the displayed symbol-bearing sides, including the different side, indicate a modified outcome of the wagering game;

in response to the modified outcome being a winning outcome, award the player an award based on the modified outcome.

2. The gaming machine of claim 1, wherein the location of each of the multi-symbol objects in the array is randomly selected.

3. The gaming machine of claim 1, wherein the side of each of the multi-symbol objects that is displayed in the array is randomly-selected.

4. The gaming machine of claim 1, wherein the location of each of the multi-symbol objects in the array and the side of each of the multi-symbol objects that is presented in the array are randomly selected.

5. The gaming machine of claim 1, wherein the different side displays a bonus symbol.

6. The gaming machine of claim 1, further comprising, prior to nudging the at least one of the multi-symbol objects, evaluating the initial outcome and, in response to the initial outcome being a winning outcome, awarding the player an award based on the initial outcome.

7. The gaming machine of claim 1, wherein the nudge of the at least one multi-symbol object occurs as a bonus event.

8. The gaming machine of claim 1, wherein the symbol-bearing sides of the multi-symbol objects include bonus symbols and non-bonus symbols and the multi-symbol objects displaying non-bonus symbols are nudged such that the multi-symbol objects displaying non-bonus symbols are rotated in order to match bonus symbols displayed on adjacent multi-symbol objects.

9. The gaming machine of claim 8, wherein the multi-symbol objects displaying non-bonus symbols are nudged such that the multi-symbol objects displaying non-bonus symbols are rotated until all possible matches with bonus symbols displayed on adjacent multi-symbol objects have been made.

10. The gaming machine of claim 1, wherein some of the plurality of sides of the multi-symbol objects are associated with special features, including bonus triggers, multipliers and free spins.

11. A method of conducting a wagering game including a randomly generated outcome, the method comprising:

receiving, via at least one input device, a wager for playing the wagering game, the wagering game including a plurality of three-dimensional multi-symbol objects, each of the plurality of multi-symbol objects having at least three symbol-bearing sides;

randomly determining, via one or more processors, the location of each of the multi-symbol objects to be displayed in an initial array;

randomly determining, via one or more processors, the side of each multi-symbol object to be displayed to a player in the initial array;

displaying, via one or more display devices, the initial array of the multi-symbol objects to the player, the initial array produced by displaying the multi-symbol objects separately tumbling downwards to settle in columns, the objects each rotating about multiple axes and displaying at least two of the symbol-bearing sides prior to settling, the objects settling such that at least one side of each multi-symbol object is displayed in the array, the symbols on the displayed symbol-bearing sides indicating an initial randomly selected outcome of the wagering game;

after displaying the initial array, nudging at least one of the multi-symbol objects such that the at least one multi-symbol object is rotated to display a different side of the multi-symbol object such that a modified array of multi-symbol objects is displayed to the player; and in response to the modified array comprises a winning outcome, awarding the player an award based on the modified array.

12. The method of claim 11, wherein the at least one nudged multi-symbol object displays a different side after the nudging than was displayed before the nudging.

13. The method of claim 11, further comprising, prior to nudging the at least one of the multi-symbol objects, evaluating the initial outcome and, in response to the initial outcome comprising a winning outcome, awarding the player an award based on the initial outcome.

14. The method of claim 11, wherein after the displaying of the multi-symbol objects in the initial array, at least one of the multi-symbol objects is moved to a different location in the array.

15. The method of claim 11, wherein after the displaying of the multi-symbol objects in the initial array, a set of the multi-symbol objects is replaced with another set of multi-symbol objects not originally displayed to the player.

16. A computer readable, non-transitory storage medium encoded with instructions for directing a gaming system to perform a method comprising:

receiving, via at least one input device, a wager initiating a play of a wagering game including a randomly generated initial outcome;

displaying, via one or more display devices, an array of multi-symbol objects of a plurality of three-dimensional multi-symbol objects, each of the plurality having at least three symbol-bearing sides, the array being produced, via one or more processors operating with the one or more display devices, by displaying the multi-symbol objects separately tumbling downwards to settle in columns, the objects each rotating about multiple axes and displaying at least two of the symbol-bearing sides prior to settling, the objects settling such that at least one side of each multi-symbol object is displayed in the array, the symbols on the displayed symbol-bearing sides indicating the initial outcome of the wagering game;

after displaying the initial outcome, nudging, via the one or more processors operating with the one or more display devices, at least one of the multi-symbol objects to display a different side of the nudged multi-symbol object, wherein the symbols on the displayed symbol-bearing sides, including the different side, indicate a modified outcome of the wagering game; and in response to the modified outcome being a winning outcome, awarding the player an award based on the modified outcome.

17. The gaming system of claim 16, further comprising, prior to the nudging, evaluating the initial outcome and, in response to the initial outcome being a winning outcome, awarding the player an award based on the initial outcome.

18. The gaming system of claim 16, wherein the one or more processors cause the one or more display devices to rotate the at least one multi-symbol object in a horizontal or a vertical direction to display the different side.

19. The gaming system of claim 16, wherein the one or more processors cause the one or more display devices to nudge the at least one multi-symbol object based on adjacent multi-symbol objects displaying bonus symbols.

20. The gaming system of claim 16, wherein the one or more processors are operative to award bonus awards, free spins and multipliers based on some of the multi-symbol objects displaying special symbols.

21. The gaming system of claim 1, wherein the multi-symbol objects are arranged in columns representing reels on a slot machine with selected reels being special reels, the multi-symbol objects on the special reels all having special bonus symbols and special non-bonus symbols such that if a first special bonus symbol is displayed adjacent a special non-bonus symbol, the multi-symbol object having the special non-bonus symbol is nudged to display a second special bonus symbol.

* * * * *